US007168586B2

(12) United States Patent
Jeon

(10) Patent No.: US 7,168,586 B2
(45) Date of Patent: Jan. 30, 2007

(54) EASILY OPENABLE CAN LID

(75) Inventor: Jeong-Wook Jeon, Pyungtaek-si (KR)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

(21) Appl. No.: 10/517,217

(22) PCT Filed: May 27, 2003

(86) PCT No.: PCT/KR03/01033

§ 371 (c)(1),
(2), (4) Date: Dec. 3, 2004

(87) PCT Pub. No.: WO03/104092

PCT Pub. Date: Dec. 18, 2003

(65) Prior Publication Data

US 2005/0224497 A1 Oct. 13, 2005

(30) Foreign Application Priority Data

Jun. 11, 2002 (KR) ..... 20-2002-0017694

(51) Int. Cl.
*B65D 17/34* (2006.01)

(52) U.S. Cl. ..... 220/269; 220/906

(58) Field of Classification Search ..... 220/269, 220/273, 272, 906, 271, 270
See application file for complete search history.

(56) References Cited

U.S. PATENT DOCUMENTS

| | | | | | |
|---|---|---|---|---|---|
| 4,266,688 | A | * | 5/1981 | Reid | 220/273 |
| 5,335,808 | A | * | 8/1994 | Lee | 220/269 |
| 5,813,561 | A | * | 9/1998 | Chang et al. | 220/269 |
| 5,947,317 | A | * | 9/1999 | Hall | 220/269 |
| 6,105,806 | A | | 8/2000 | Stasiuk | |

FOREIGN PATENT DOCUMENTS

| | | | | |
|---|---|---|---|---|
| GB | 2320008 | * | 6/1998 | 220/269 |
| JP | 2003-54549 | * | 2/2003 | 220/269 |
| JP | 2003-112735 | * | 4/2003 | 220/269 |

* cited by examiner

*Primary Examiner*—Lien M. Ngo
(74) *Attorney, Agent, or Firm*—Diller, Ramik & Wight

(57) ABSTRACT

A can lid of a can provided with an easily openable opening means is disclosed wherein the can lid is equipped with a can lid which is fastened by winding tightly on the can main body and the top end opening of the can main body, a score section installed around the territory of the prearranged opening area and a tab for severing the score section. In the can lid, there is formed a protrusion protruding upward from the can lid in front of the can opening during manufacturing of the can lid, in which it is a collapsing protrusion where the protrusion elastically deforms into the can main body by depressing motion of the user and thereby enables forming of a concave section for easy insertion of the user's finger.

3 Claims, 3 Drawing Sheets

EASILY OPENABLE CAN LID

TECHNICAL FIELD

The present invention is related to a can which enables easy partial opening or full opening of the lid, and in particular to an easily openable can lid provided with a collapsing protrusion.

BACKGROUND ART

Generally, easily opening lids are required in cans and therefore can lids with easily openable means are installed.

However, in the case of cans provided with easily openable means, easy opening of the can is required but the gap between the handle tab and the top panel of the can is very small and therefore the hooking of the finger is not favorable and thus there is a tendency of it being difficult to open. As a countermeasure, a method of providing a concave portion underneath the tab or a convex portion on the top surface of the can and lifting the tab has been devised. However, if the depth of the concave or convex portion becomes large, there is the problem of tabs of other can lids being caught between the tab and can lid during manufacturing and return transportation and causing damage.

SUMMARY OF THE INVENTION

The present invention has been set forth to overcome the problems of the conventional cans where the object thereof is to provide a can lid provided with an easily openable opening means in which hooking of the finger is facilitated and where there are no problems during manufacturing or transportation.

To achieve the foregoing object, in the present invention in which a can lid of a can provided with an easily openable opening means equipped with a can lid which is fastened by winding tightly on the can main body and the top end opening of the can main body, a score section is installed around the territory of the prearranged opening area and a tab for severing the score section, where in said can lid, there is formed a protrusion protruding upward from the can lid in front of the can opening during manufacturing of the can lid, in which it is a collapsing protrusion where the protrusion elastically deforms into the can main body by depressing motion of the user and thereby enables forming of a concave section for easy insertion of the user's finger. In addition, it is preferred that the end of the handle of said tab lies over the collapsing protrusion.

DESCRIPTION OF THE PREFERRED EMBODIMENTS

Figure 1:
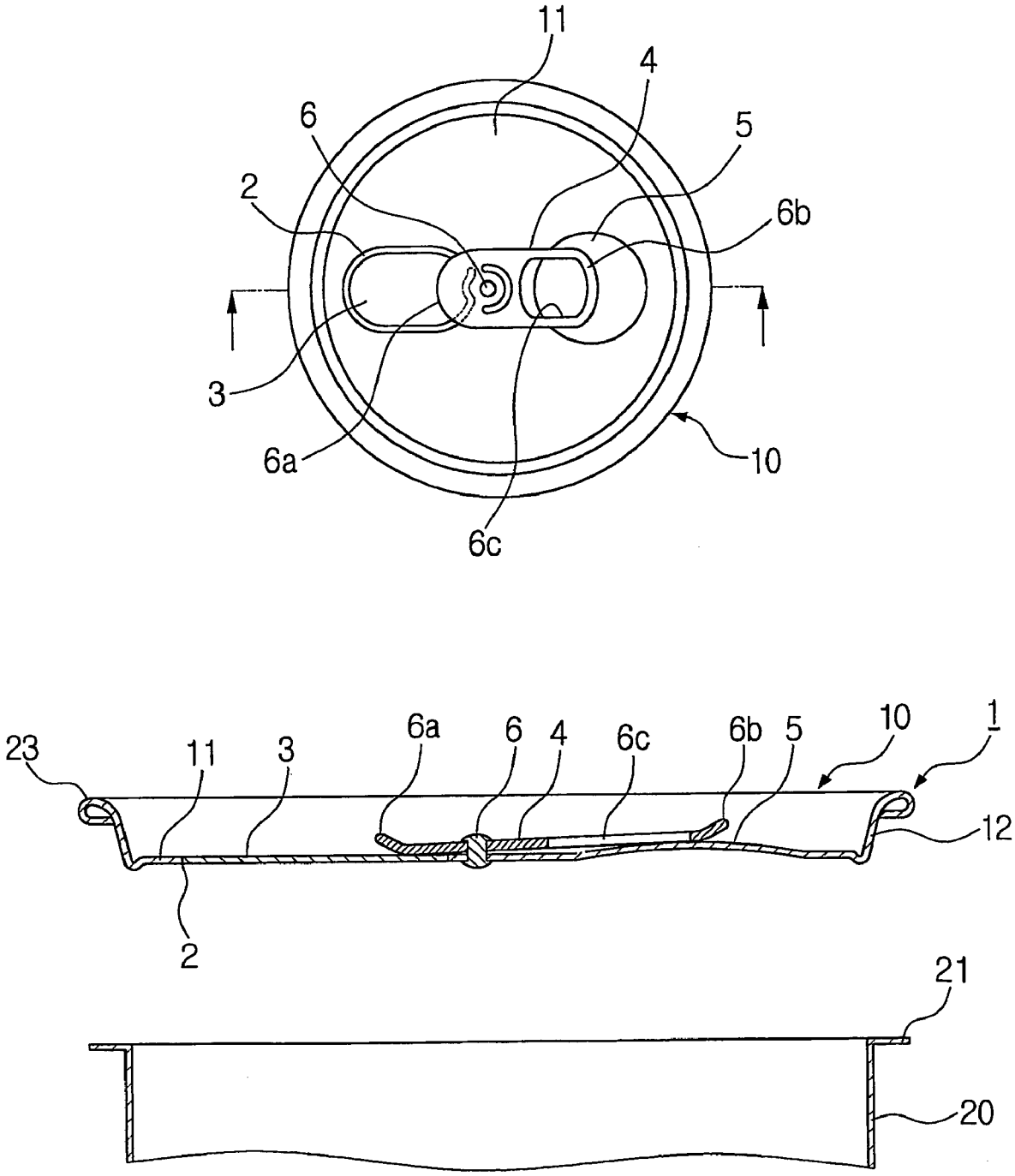
FIG. 1 is a front view and a cross-sectional view of the can lid according to the preferred embodiment of the present invention.

The preferred embodiments of the present invention will be described in detail with reference to the attached drawings. FIG. 1 depicts a partial opening can type provided with an easy opening means related to the preferred embodiment of the present invention.

This partial opening type can is equipped with a cylindrical shaped main body (20) provided with a can bottom, not shown, and a can lid (1) which is wound and fastened on the top end opening of the can main body. This can lid (1) is provided with a lid main body (10) and a tab (4) for severing the scored section (2) for the partial opening engraved on the lid main body (10).

The lid main body (10) is comprised of a circular-shaped panel (11), a circumference wall (12) which elevates from the circumference edge of the panel (11), and a curl portion (23) which extends outward from the circumference wall (12) and gets wound together with the flange (21) of the can main body (20), where the partial opening score section (2) is formed on the circumference of the prearranged partial opening area (3) of the panel (11) and enables opening of the prearranged partial opening area (3) of the panel (11).

In addition, on the panel (11) of the can lid (1), a collapsing protrusion (5) which protrudes upward from the panel (11) is formed during the manufacturing process. After manufacturing, this collapsing protrusion (5) is elastically deformed and protrudes inward into the can main body (20) about the boundary between the collapsing protrusion (5) and panel (11) by the depressing action of the user and thus provides a concave section where a finger may be inserted.

The tab (4) is an oval shape and is fastened on the rivet (6) located on the panel (11). This tab (4) is arranged such that the longitudinal direction is along the direction of the diameter of the panel (11) and the tab end (6*a*) which severs the score section (2) is arranged near the score section (2), and the handle (6*b*) for lifting the tab (4) is arranged on the panel (11). The rivet (6) is located between the tab end (6*a*) and handle (6*b*) toward the tab end (6*a*). The handle (6*b*) is ring-shaped and a finger-hooking hole (6*c*) is formed thereon. The handle (6*b*) is arranged such that it lies over the collapsing protrusion (5). At a free state, the tab (4) is fastened to the rivet of the panel (11) which is lower than the collapsing protrusion (5) and therefore the handle (6*b*) is initially at an elevated state and the far end of the handle is on top of the collapsing protrusion (5) and is abutting the collapsing protrusion (5) without a gap.

Figure 2:
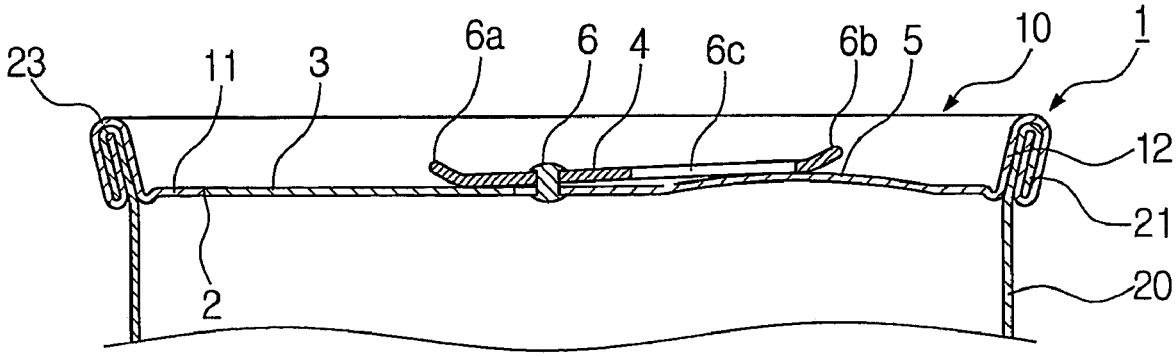
FIG. 2 is a cross-sectional view of the collapsing protrusion of the can lid of FIG. 1 depicting the before and after depression states.
Figure 2:
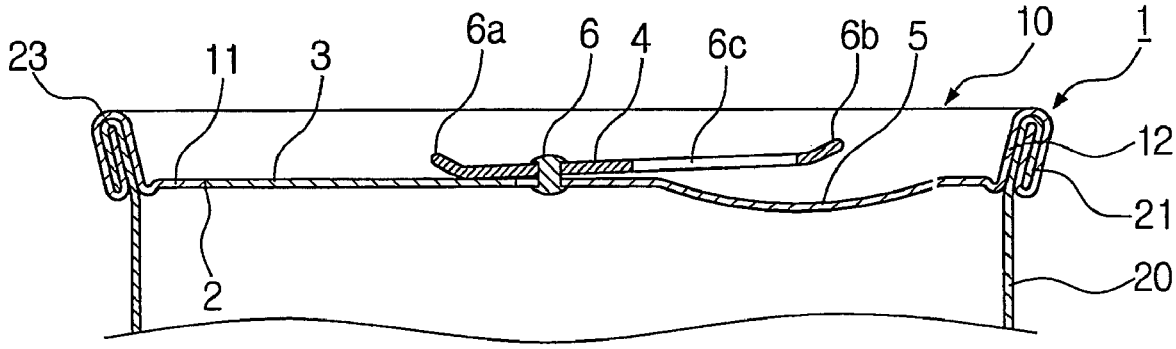
Figure 3:
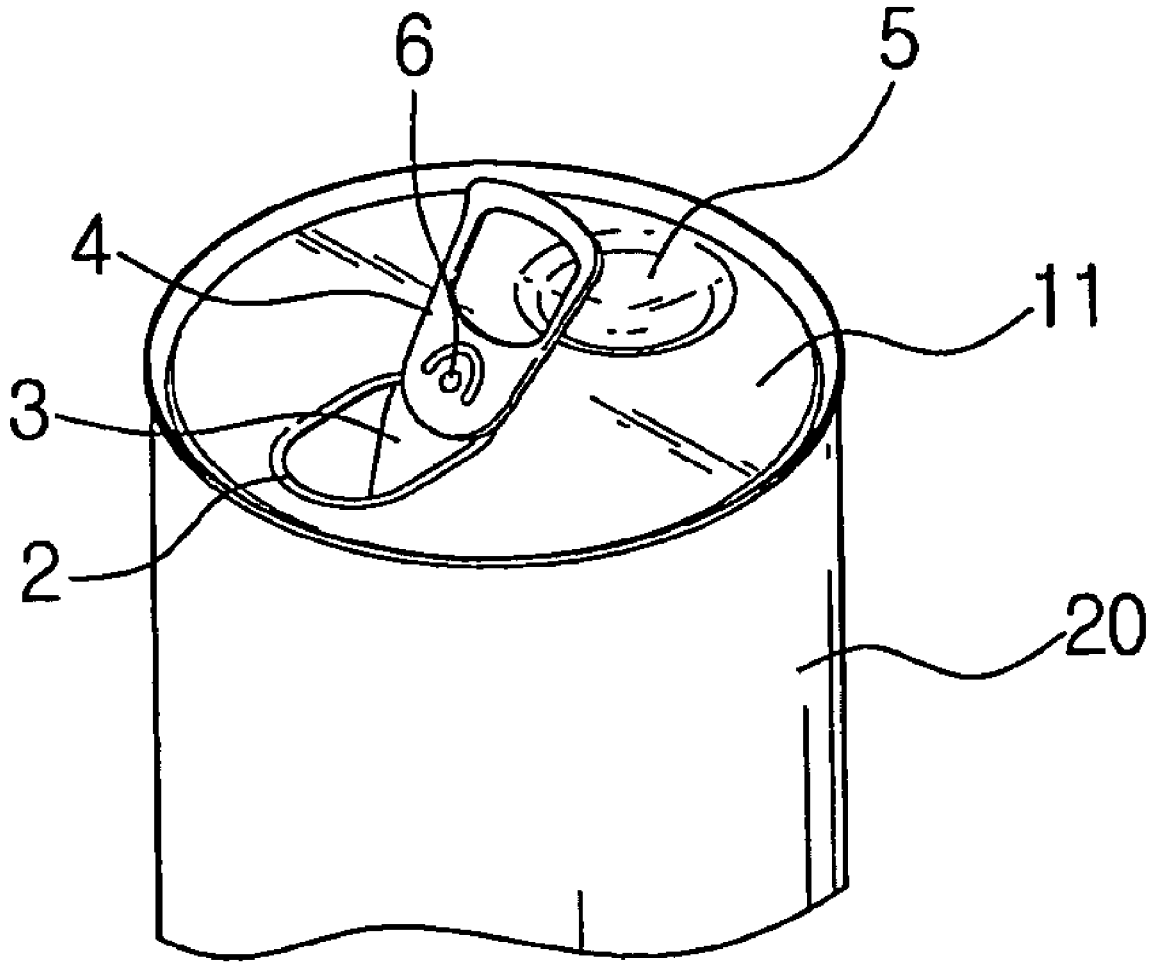
FIG. 3 is a perspective view showing the state after opening of the can lid of FIG. 1.

When the user depresses the collapsing protrusion (5), as depicted in FIG. 2, the collapsing protrusion elastically deforms and a gap is formed between the collapsing protrusion (5) and the far end of the handle (6*b*). In this case, the handle (6*b*) abuts the boundary of the collapsing protrusion (5) and thus a secure gap is formed. By providing a collapsing protrusion (5) as such, when the user depresses the collapsing protrusion (5) to form a partial opening on the can, a gap is formed and thereby hooking of the finger is facilitated and as a result, a partial opening on the can may be easily formed. Therefore, because the collapsing protrusion (5) is not a concave shape during the manufacturing process of the can lid (1), it does not abut the handle (6*b*) of the tab or the gap is narrow and thus it is very difficult for other can lids to be inserted between the tab (4) and the panel (11) during the manufacturing process or transportation, and in turn there may be no cases of damage from contact with other cans.

It is obviously preferred that there is typography (not shown) printed on the collapsing protrusion intended as instructions or a logo and advertising.

In addition, as the material of the can lid (1), either one of aluminum or steel may be used. For the thickness of the panel, it is preferred that the thickness remains thin for easy elastic deformation.

In the above preferred embodiment, the shape of the collapsing protrusion is represented as a concentric circle. However, it is not limited to this shape and namely, it may be of any construction that is easily deformed and formed into a concave section by the depressing of the user. Also, although a can lid having a partial opening means has been described, it is obvious that the present invention may be applied to a can lid having a wholly opening means.

As described above in the present invention, by providing a collapsing protrusion, gripping of the tab handle is facilitated and thereby the opening of the can is made easy.

Also, the collapsing protrusion is not a concave shape during the manufacturing process and therefore the gap of the handle of the tab is narrow and thus it is difficult for other can lids to be inserted between the tab and panel during the manufacturing or transportation process and in turn there is no concern for the tab or concave portion being damaged from contact with other can lids.

The invention claimed is:

1. An easy-opening can end comprising an end panel, a score line in said end panel definding an openable panel portion; a pull tab defined by a nose, a handle and a medial portion between said nose and handle; means for securing said medial portion to said end panel with said nose adjacent said score line, said end panel including a convexly upwardly projecting protrusion underlying and contiguous said handle, and means definded by the material of said protrusion of elastically deforming said convexly upwardly projecting protrusion to an upwardly concavely opening and downwardly projecting protrusion upon the application of a downwardly directed manually applied force to said convexly upwardly projecting protrusion to form a gap between said handle and said elastically deformed upwardly concavely opening protrusion incident to severing said score line by imparting a lifting force to said handle.

2. The easy-opening can end as defined in claim 1 wherein said handle overlies said upwardly convexly projecting and upwardly concavely opening protrusion incident to imparting a lifting force to said handle.

3. The easy-opening can end as defined in claim 2 wherein said handle is contiguous said upwardly convexly projecting protrusion and defines a finger gripping gap with said protrusion in the upwardly concavely opening configuration thereof.

* * * * *